US009242839B2

(12) United States Patent
Bailey et al.

(10) Patent No.: US 9,242,839 B2
(45) Date of Patent: Jan. 26, 2016

(54) LIFT-EYE IN POCKET APPARATUS AND METHODS

(71) Applicant: Nabors Drilling International Limited, Hamilton (BM)

(72) Inventors: Sean M. Bailey, Willis, TX (US); Padira Reddy, Richmond, TX (US)

(73) Assignee: Nabors Drilling International Limited, Hamilton (BM)

( * ) Notice: Subject to any disclaimer, the term of this patent is extended or adjusted under 35 U.S.C. 154(b) by 0 days.

(21) Appl. No.: 14/326,803

(22) Filed: Jul. 9, 2014

(65) Prior Publication Data

US 2015/0015009 A1 Jan. 15, 2015

Related U.S. Application Data

(60) Provisional application No. 61/845,692, filed on Jul. 12, 2013.

(51) Int. Cl.
*B65D 88/12* (2006.01)
*B66C 1/66* (2006.01)

(52) U.S. Cl.
CPC ..... *B66C 1/663* (2013.01); *B65D 88/121* (2013.01); *Y10T 29/49716* (2015.01)

(58) Field of Classification Search
CPC ..... B66C 1/66; B66C 1/663; B66C 1/666; B65D 88/121; Y10T 29/49716
USPC ..... 294/68.1, 68.3, 215; 220/1.5; 410/111
See application file for complete search history.

(56) References Cited

U.S. PATENT DOCUMENTS

| | | | | |
|---|---|---|---|---|
| 1,830,998 | A | | 11/1931 | Harbord |
| 2,478,192 | A | * | 8/1949 | Harker ..... 294/82.1 |
| 2,998,156 | A | | 8/1961 | Stricker, Jr. |
| 3,148,909 | A | | 9/1964 | Tantlinger |
| 3,189,376 | A | * | 6/1965 | Johansson ..... 294/68.1 |
| 3,485,523 | A | * | 12/1969 | Carr ..... 296/186.3 |
| 4,517,882 | A | * | 5/1985 | Watanabe et al. ..... 454/118 |
| 4,741,653 | A | * | 5/1988 | Schmidt ..... 410/111 |
| 4,788,927 | A | | 12/1988 | Casey |
| 4,925,226 | A | | 5/1990 | Leonard, Jr. et al. |
| 5,346,084 | A | | 9/1994 | Jurgevich |
| 5,598,803 | A | | 2/1997 | Czipri |

(Continued)

FOREIGN PATENT DOCUMENTS

| | | |
|---|---|---|
| EP | 2 535 297 A1 | 12/2012 |
| FR | 2 766 145 A1 | 1/1999 |

OTHER PUBLICATIONS

"Pickup Truck Bed Rail Pop-Up Anchor" Discount Ramps LLC, http://www.discountramps.com/pop-up-anchor.htm, May 21, 2013, 2 pages.

(Continued)

*Primary Examiner* — Dean Kramer
(74) *Attorney, Agent, or Firm* — Haynes and Boone, LLP

(57) ABSTRACT

An apparatus for shipping goods may include a strut, a first beam, a second beam, a lift-eye housing interfacing with the strut, the first beam, and the second beam, and having an opening facing in the direction of the upper wall, and a lift-eye disposed within the lift-eye housing and configured to support the weight of the apparatus and to pivot from a stowed position within the lift-eye housing to a deployed position where a distal portion of the lift-eye projects out of the lift-eye housing.

22 Claims, 6 Drawing Sheets

(56) References Cited

U.S. PATENT DOCUMENTS

| | | | | |
|---|---|---|---|---|
| 5,927,780 | A | 7/1999 | Chandler | |
| 6,652,012 | B1 | 11/2003 | Fuller et al. | |
| 7,131,387 | B1 | 11/2006 | Czipri | |
| 7,988,211 | B2 | 8/2011 | Anderson | |
| 2006/0249509 | A1* | 11/2006 | Solano | 220/1.5 |
| 2009/0134171 | A1* | 5/2009 | deBerardinis | 220/562 |

OTHER PUBLICATIONS

"RUD RBG—VRBG Bolted Lifting Lugs" DLH Online Lifting, Handling and Height Safety Equipment, www.dlhonline.co.uk/rud-rbg---vrbf-bolted-lifting-lugs-8771-p.asp, May 21, 2013, 3 pages.

* cited by examiner

Fig. 1 - Prior Art

LIFT-EYE IN POCKET APPARATUS AND METHODS

PRIORITY DATA

This application claims priority to Provisional Patent Application No. 61/845,692, filed Jul. 12, 2013, and entitled "Lift-Eye in Pocket Apparatus and Methods," the disclosure of which is hereby incorporated by reference in its entirety.

TECHNICAL FIELD OF THE DISCLOSURE

The present disclosure relates generally to methods and apparatuses, such as fabricated structures, used for transporting drilling rig components and systems, and in particular to apparatuses, such as lift-eyes attached to the fabricated structures that facilitate transportation by enabling cranes and other devices to connect to the large structures.

BACKGROUND OF THE DISCLOSURE

Global shipping, such as of drilling rig components and systems, necessarily involves large fabricated structures. The structures often require the assistance of cranes for transportation. Most structures have lift-eyes that enable cranes and other transportation devices to connect to and carry the structures during operation.

Shipping costs of the fabricated structures are often based on the total volume occupied by the structures. Conventional lift-eyes are attached externally to the fabricated structures. Such a configuration increases the overall volume occupied by each container because the protruding lift-eyes prevent the structures from seamlessly stacking end to end.

FIG. 1 is a perspective view of a first conventional fabricated structure 100 and a second conventional fabricated structure 110 with a plurality of protruding lift-eyes 115*a*, 115*b*, 115*c*, 115*d*, 115*e*, 115*f*. The protruding lift-eye 115*a* adds to the total volume occupied by each container by an amount equal to the height, h, of the protruding lift eye 115*a* multiplied by the length, l, and width, w, of either fabricated structure 100, 110 because the first conventional fabricated structure 100 cannot be stacked directly atop the second conventional fabricated structure 110. This additional volume forces companies to pay increased shipping costs without obtaining any additional storage capacity.

Other lift-eyes do not protrude from the fabricated structure and may, instead, be stored within the structure. However, these lift-eyes are stowed within the interior of the fabricated structure and therefore occupy available space that would otherwise be available for occupation by the systems and components requiring space. Therefore, companies must design larger fabricated structures to meet the needs of some structures.

Further, many fabricated structures are limited in the loads they can handle because the lift-eyes installed in them are only capable of withstanding certain conditions and loads. This limitation requires some companies to design for larger, heavier fabricated structures, although they do not require the extra volume, because the larger structures have more durable lift-eyes.

The present disclosure provides a lift-eye in pocket apparatuses and methods to overcome some of the disadvantages of conventional fabricated structures, as further disclosed below.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 5-1 is a cross-sectional view of an apparatus as a lift-eye according to one or more aspects of the present disclosure.

FIG. 5-2 is a cross-sectional view of an apparatus as a lift-eye according to one or more aspects of the present disclosure.

FIG. 5-3 is a cross-sectional view of an apparatus as a lift-eye according to one or more aspects of the present disclosure.

DETAILED DESCRIPTION

Figure 1:
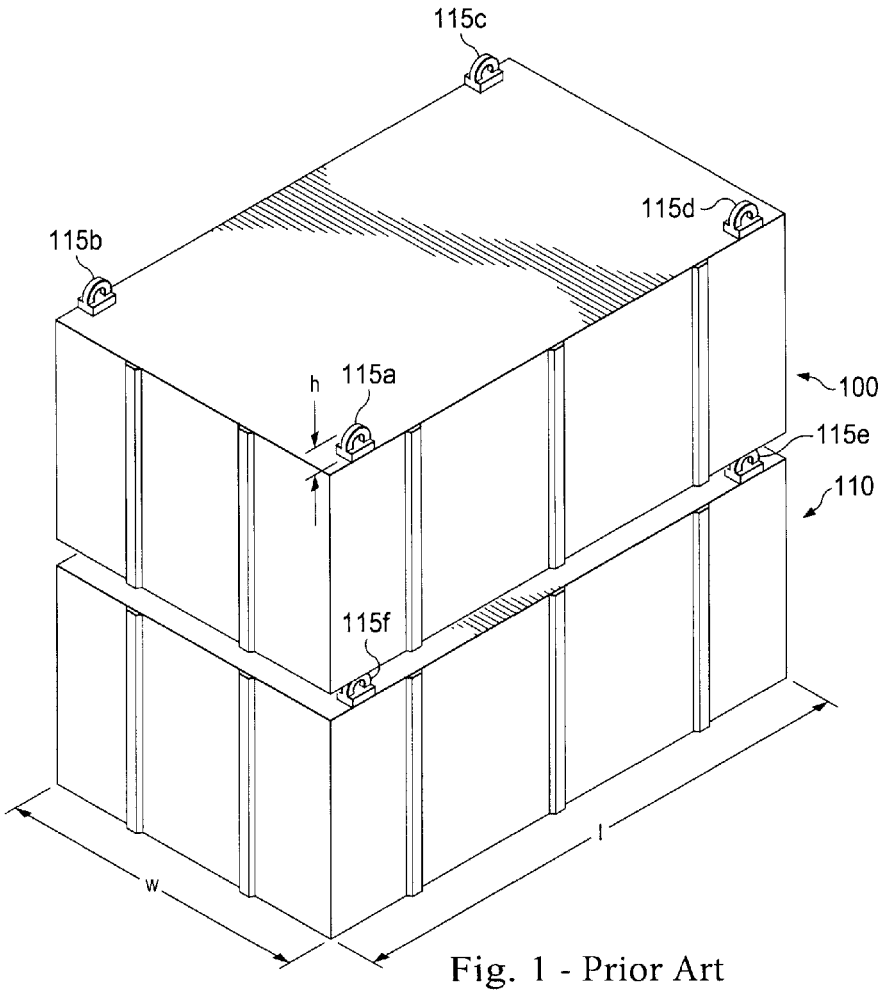
FIG. 1 is a perspective view of two conventional fabricated structures with protruding lift-eyes.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure is directed to apparatuses and methods that may allow a maximum amount of shipping space to be utilized. For example, the present disclosure describes exemplary fabricated structures that incorporate a swivel lift-eye system that may be deployed when used to facilitate lifting of the fabricated structure, but that may be stowed within a pocket beneath the structure surface when the structure is ready for shipping. Because the swivel lift-eye system has a smaller profile when stowed, structures may abut against each other with minimal space therebetween. This results in more effective use of space, and may reduce the costs of shipping the structures.

In addition, in some aspects, the swivel lift-eye system is contained within the framework of the structure. Accordingly, the swivel lift-eye system does not require or take up extra space within the structure itself. Thus, the space within the structure of the present disclosure may be more efficiently utilized for the shipping of components, and the structure itself may also be larger than a conventional fabricated structure because it need not account for the necessary headroom for a conventional lift-eye system 115*a*-115*f* that protrudes above the conventional structure shown in FIG. 1. In some aspects of the present disclosure, the swivel lift-eye system includes lift-eyes that may be replaced or exchanged from the exterior of the structure. The lift-eye may be exchanged based on the shipping requirements and the weight of the loaded structure.

Figure 2:
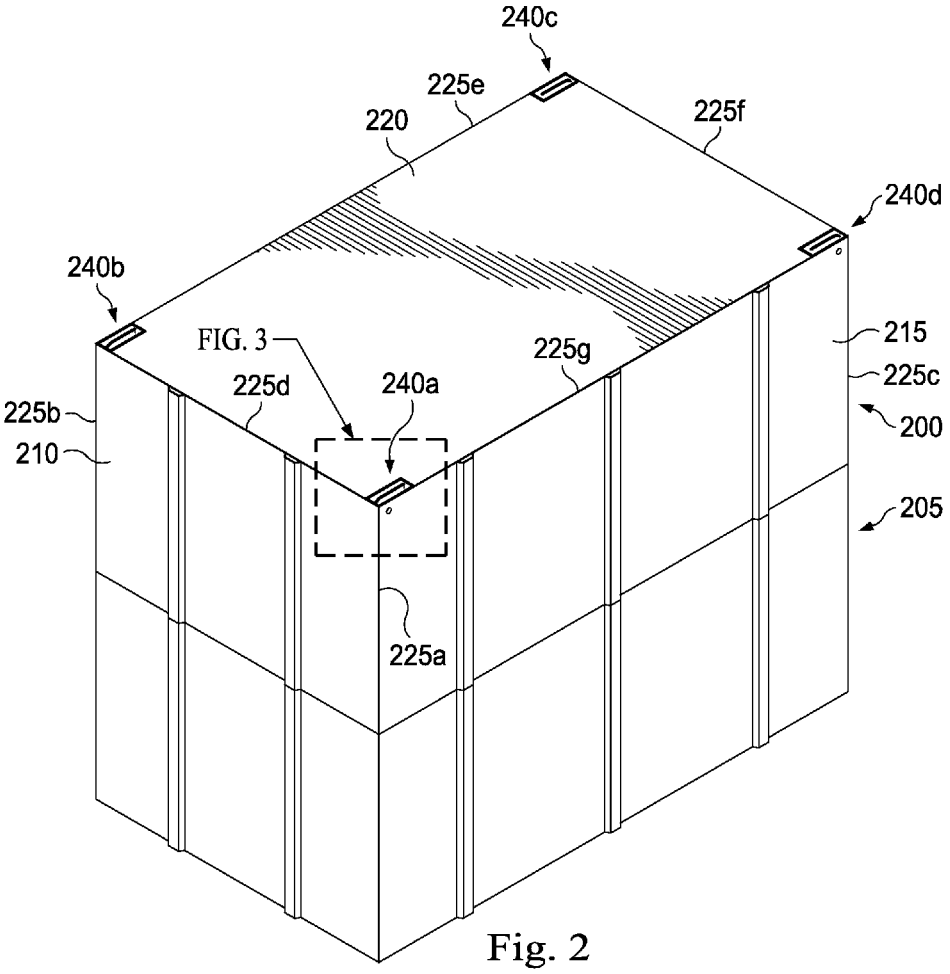
FIG. 2 is a perspective view of fabricated structures according to one or more aspects of the present disclosure.

Referring to FIG. 2, illustrated is a perspective view of a fabricated structure 200 and an identical fabricated structure 205. In several exemplary embodiments, the fabricated structure 200 includes a plurality of sides including, but not limited to, a first exterior sidewall 210, a second exterior sidewall 215, and an upper wall 220. The fabricated structure 200 also includes opposing sidewalls and a floor that are not visible in the view shown in FIG. 2. The sides may include a sturdy material, such as a metal material, including for example, steel or aluminum, or an alloy thereof, one or more polymeric materials, a composite material, and/or a variety of other materials (including combinations of materials) known in the art. While the fabricated structures 200, 205 in FIG. 2 are shown as container type fabricated structures, other embodiments are not containers, but are fabricated structures employing the systems and principles described herein. In several exemplary embodiments, the fabricated structures 200, 205 do not include the exterior sidewalls, as will become apparent from the description below. In some examples, the fabricated structures are sections or portions of drilling equipment, such as, for example, a portion of a drilling rig. This may include, among other drilling rig elements, portions of a rig floor, rig supports, or other portions of a drilling rig.

In several exemplary embodiments including those shown in FIG. 2, the fabricated structure 200 includes a plurality of edges 225*a*, 225*b*, 225*c*, 225*d*, 225*e*, 225*f*, and 225*g* between the various sidewalls and the upper wall 220. In several exemplary embodiments, the edges 225*a*, 225*b*, 225*c*, 225*d*, 225*e*, 225*f*, and 225*g* are the interfaces of the exterior sidewalls 210, 215, each with the upper wall 220. The fabricated structure 200 also includes edges that are the interfaces of the opposing sidewalls and the floor that are not visible in the view shown in FIG. 2. As can be seen in FIG. 2, the fabricated structure 200 includes a plurality of reversible swivel lift-eye systems 240*a*, 240*b*, 240*c*, and 240*d*. The swivel lift-eye systems 240*a*, 240*b*, 240*c*, and 240*d* are disposed at the corners of the fabricated structure 200, at the edges 225*a*, 225*b*, 225*c*, 225*d*, 225*e*, 225*f*, and 225*g* of the exterior sidewalls and the upper wall 220.

Figure 3:
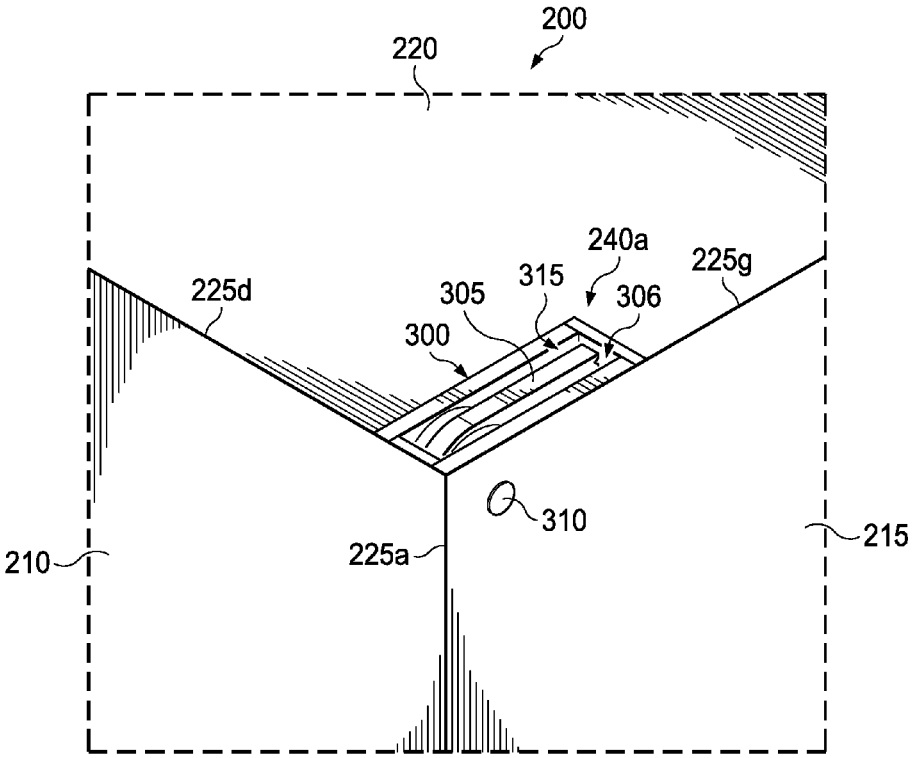
FIG. 3 is a perspective view of an apparatus as a portion of a fabricated structure shown in FIG. 2 according to one or more aspects of the present disclosure.

FIG. 3 shows a more detailed view of the corner of the fabricated structure 200 having the swivel lift-eye system 240*a* disposed therein. In several exemplary embodiments, the swivel lift-eye system 240*a* includes a lift-eye housing 300 and a reversibly pivotable lift-eye 305. In several exemplary embodiments, the lift-eye housing 300 includes a pocket, referenced herein as an opening 306, facing in the direction of the upper wall 220. In several exemplary embodiments, the lift-eye 305 is displaced within the lift-eye housing 300 and is configured to reversibly rotate about a removable pivot pin 310 between a stowed position where the lift-eye 305 is retracted into the lift-eye housing 300 and does not project through the opening 306 of the lift-eye housing 300 and a deployed position where a distal portion 315 of the lift-eye 305 projects out of the lift-eye housing 300 and above the plane of the upper wall 220. This can facilitate connection with a lifting device to handle and move fabricated structures for loading and unloading the fabricated structures in and out of a cargo transport vehicle. In several exemplary embodiments, the removable pivot pin 310 extends through the second exterior sidewall 215, the lift-eye housing 300, and the lift-eye 305 and is accessible from outside the fabricated structure 200. The removable pivot pin 310 may be independently formed to include any of the materials discussed above, including metals, polymers, composites, alloys, combinations, or other suitable materials known in the art.

Figure 4:
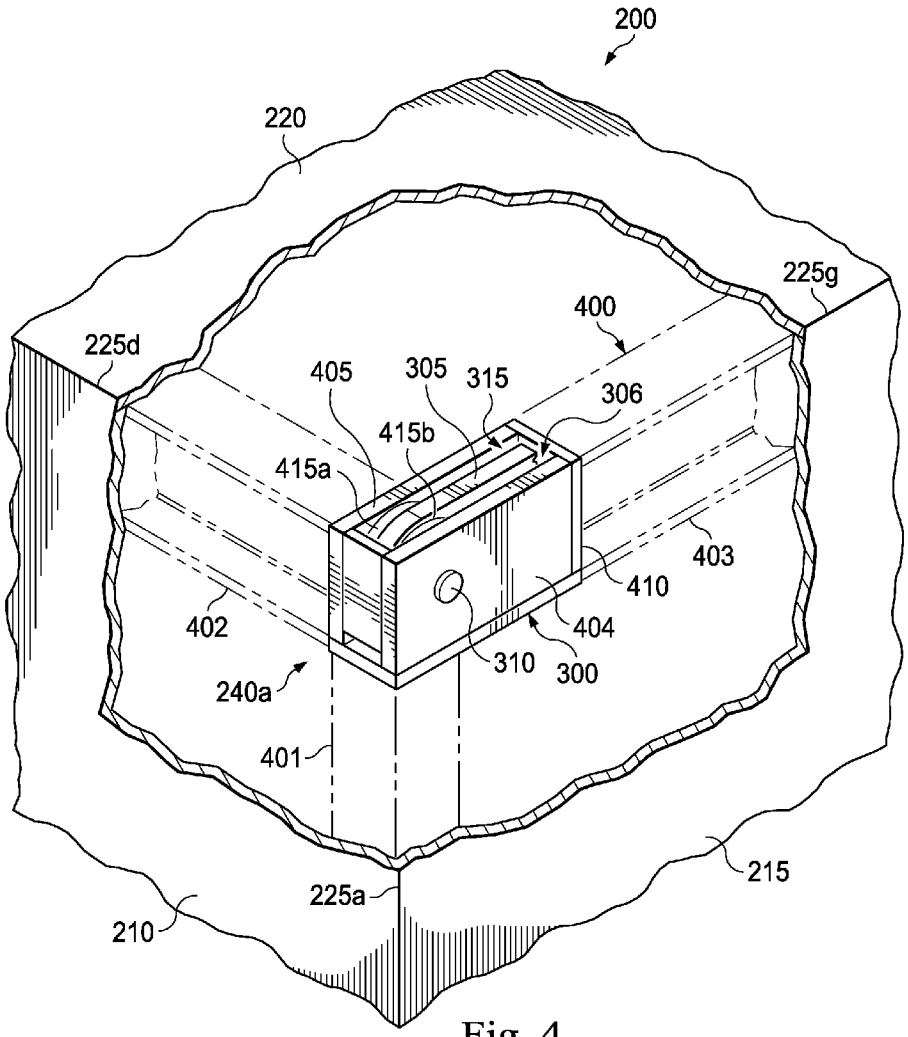
FIG. 4 is a partial cross-sectional view of an apparatus as a portion of a fabricated structure shown in FIG. 2 according to one or more aspects of the present disclosure.
Figures 1, 5:
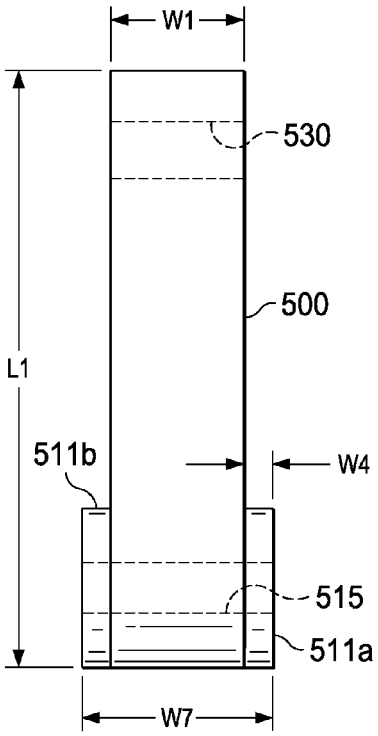
Figures 2, 5:
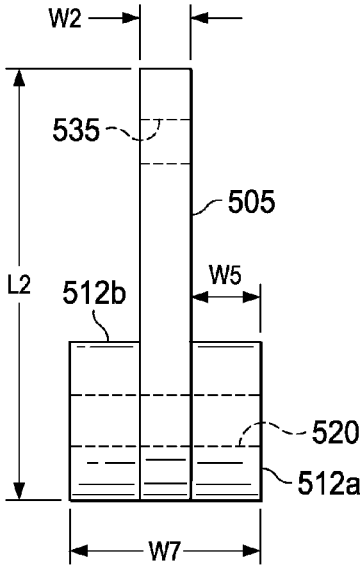
Figures 3, 5:
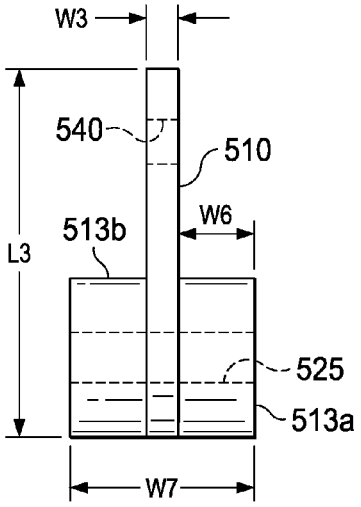

FIG. 4 shows the corner of the fabricated structure 200 in FIG. 3 with a portion of the exterior sidewalls 210, 215 and a portion of the upper wall 220 cut away. In several exemplary embodiments, the fabricated structure 200 includes a frame 400, which includes at least one strut 401, and a plurality of beams including, but not limited to, a first beam 402 and a second beam 403. In an exemplary embodiment, the strut 401, the first beam 402, and the second beam 403 extend inside the fabricated structure 200 along the edges 225*a*, 225*d*, and 225*g*, respectively. In an exemplary embodiment, the strut 401 is positioned between and connecting the first exterior sidewall 210 and the second exterior sidewall 215. In one embodiment, the strut 401 is connected to the first exterior sidewall 210 and the second exterior sidewall 215 by welding. The strut 401 may be connected to the first exterior sidewall 210 and the second exterior sidewall 215, including by rivets, fasteners, adhesives and/or a variety of other coupling techniques and/or materials known in the art. The strut 401 may be any type of compression load bearing structure. In several exemplary embodiments, the first beam 402 is positioned between and connects the first exterior sidewall 210 and the upper wall 220. In one embodiment, the first beam 402 is connected to the first exterior sidewall 210 and the upper wall 220 by welding. The first beam 402 may be connected to the first exterior sidewall 210 and the upper wall 220, however, by rivets, fasteners, adhesives and/or a variety of other coupling techniques and/or materials known in the art. In several exemplary embodiments, the second beam 403 is positioned between and connecting the second exterior sidewall 215 and the upper wall 220. In one embodiment, the second beam 403 is connected to the second exterior sidewall 215 and the upper wall 220 by welding. The second beam 403 may be connected to the second exterior sidewall 215 and the upper wall 220, however, by rivets, fasteners, adhesives, and/or other coupling mediums known in the art. Examples of types of beams may include I-beams, C-beams, and/or any of a variety of load-withstanding structures available to those of ordinary skill in the art. The beams 402, 403 may be independently formed to include any of the materials, alloys, or combinations discussed above, including metals, polymers, composites, or other suitable materials known in the art. In some embodiments, the fabricated structure includes the frame 400 without the sidewalls described above.

In several exemplary embodiments, the swivel lift-eye system 240*a* is built into and forms a part of the frame 400 of the apparatus, such as the depicted fabricated structure 200. In the embodiment shown, the swivel-lift-eye system 240*a* is disposed in-line with at least a portion, or in-line with, the second beam 403, and is connected to and forms a bridge between the strut 401 and the first and second beams 402, 403. In operation, the swivel lift-eye system 240*a* may be used to connect a crane or other device to the fabricated structure 200 for transportation, but when not in use may be fully stowed within the frame 400 such that the bottom of the fabricated structure 200 may abut directly against the top of the fabricated structure 205 shown in FIG. 3. Further, in several exemplary embodiments, the positioning of the swivel lift-eye system 240*a* within the frame 400 is such that the swivel lift-eye system 240*a* does not occupy any storage space within the fabricated structure 200. In the example shown, the swivel lift-eye system 240*a* is disposed below the flat exterior surface forming the upper wall 220.

In an exemplary embodiment, the lift-eye housing 300 includes an outer wall 404, an inner wall 405, and an end wall 410. In several exemplary embodiments, the lift-eye housing 300 is disposed and connected directly along a top end of the strut 401. In several exemplary embodiments, the inner wall 405 of the lift-eye housing 300 abuts against and is connected to an end of the first beam 402 and the end wall 410 of the lift-eye housing 300 abuts against and is connected to an end of the second beam 403. In several exemplary embodiments, the positioning of the lift-eye housing 300 forms a part of the frame 400 of the fabricated structure 200 at a corner and, as such, the swivel lift-eye system 420*a* does not occupy any additional storage space within the fabricated structure 200 that could otherwise be used for shipping goods. In one embodiment, the lift-eye housing 300 is connected to the strut 401, the first beam 402, and the second beam 403 by a welding method adapted to support the weight of the loaded fabricated structure 200 during lifting and transportation. The lift-eye housing 300 may be connected to the strut 401, the first beam 402, and the second beam 403, however, by rivets, fasteners, adhesives and/or a variety of other coupling techniques and/or materials known in the art to support the weight of the fabricated structure 200 during lifting and transportation.

In several exemplary embodiments, the lift-eye 305 is positioned within the lift-eye housing 300 and is configured to pivot at least partially around the removable pivot pin 310 from a stowed position within the lift-eye housing 300 to a deployed position with the distal portion 315 extending out of the opening 306 of the lift-eye housing 300 and past the planar surface of the upper wall 220. As discussed in further detail below, in one embodiment, a force may be applied to the lift-eye 305 such that the lift-eye 305 pivots about the removable pivot pin 310 to the deployed position. In several embodiments, the lift-eye 305 may be exchanged for a lift-eye selected from a plurality of differently rated lift-eyes depending on load requirements. As will be discussed in further detail below, in several exemplary embodiments, the lift-eye 305 is coupled to a pair of cheek plates 415*a* and 415*b* that vary in width depending on the width of the lift-eye 305, such that various lift-eye-cheek plate combinations occupy the same width, measured along the end wall 410, inside the lift-eye housing 300, facilitating exchange between lift-eyes with varying load withstanding capabilities.

In several exemplary embodiments, the removable pivot pin 310 enables a user to replace the lift-eye 305 with any of a plurality of lift-eyes configured to meet the user's load requirements. The user's shipping needs may relate to the fabricated structure 200 load requirements, weather conditions, types of transportation devices, and/or a variety of other factors known in the art. In several exemplary embodiments, the removable pivot pin 310 is accessible from outside the fabricated structure 200 such that after the pin 310 is removed, the lift-eye 305 may be removed and replaced with an alternative lift-eye capable of meeting a user's needs without disassembling any portion of the frame 400, the lift-eye housing 300, and/or any other components of the fabricated structure 200. In an exemplary embodiment, to exchange the lift-eye 305 for a more suitable lift-eye within the lift-eye housing 300, a user first evaluates the needs of the fabricated structure 200. After the user determines the needs of the fabricated structure 200, the user selects a lift-eye capable of operating under the weight, size, and/or a variety of other needs of the fabricated structure 200. The user applies a force to the removable pivot pin 310 to remove it from the lift-eye housing 300 and the fabricated structure 200. In one embodiment, to remove the removable pivot pin 310, a user applies a force to pull the removable pivot pin 310 from the lift-eye housing 300. The force may be applied by manually grasping and pulling the removable pivot pin 310, or may be a mechanical force, magnetic force, and/or other force(s) known in the art. In an exemplary embodiment, the user then inserts the selected lift-eye (not shown) into the lift-eye housing 300 and re-inserts the removable pivot pin 310 through the second exterior side wall 215 of the fabricated structure 200, the outer wall 404 of the lift-eye housing 300, the selected lift-eye, and the inner wall 405 of the lift-eye housing 300 such that the selected lift-eye is secured within the lift-eye housing 300.

Referring to FIGS. 5-1, 5-2, and 5-3, illustrated are two-dimensional views of exemplary lift-eyes 500, 505, and 510. In several exemplary embodiments, the lift-eyes 500, 505, 510 are functionally similar to and exchangeable with the lift-eye 305. In several exemplary embodiments, the lift-eyes 500, 505, 510 are coupled to sets of cheek plates 511*a* and 511*b*, 512*a* and 512*b*, and 513*a* and 513*b*, respectively. In one embodiment, the lift-eyes 500, 505, 510 are connected by welding to the respective cheek plates 511*a* and 511*b*, 512*a* and 512*b*, and 513*a* and 513*b*. The lift-eyes 500, 505, 510 can be connected to the respective cheek plates 511*a* and 511*b*, 512*a* and 512*b*, and 513*a*, however, by rivets, fasteners, adhesives, and/or a variety of other coupling techniques and/or methods known in the art. In one embodiment, the cheek plates 511*a* and 511*b*, 512*a* and 512*b*, and 513*a* and 513*b* are washers. However, the cheek plates 511*a* and 511*b*, 512*a* and 512*b*, and 513*a* and 513*b* may be wear pads, nuts, spacers, and/or a variety of other devices known in the art. The cheek plates 511*a* and 511*b*, 512*a* and 512*b*, and 513*a* and 513*b* need not be circular, but can be any other suitable shape including rectangular, oval, elongated, square, etc., and may be independently formed to include any of the materials or alloys, composites, or combinations discussed above, including metals, polymers, composites, or other suitable matters.

In several exemplary embodiments, the lift-eye 500 and the cheek plates 511*a* and 511*b* include a pivot pin hole 515, the lift-eye 505 and the cheek plates 512*a* and 512*b* include a pivot pin hole 520, and the lift-eye 510 and the cheek plates 513*a* and 513*b* include a pivot pin hole 525. In several exemplary embodiments, the pivot pin holes 515, 520, 525 are configured to allow the removable pivot pin 310 to extend through the respective lift-eyes 500, 505, 510. As such, they all have the same diameter. In several exemplary embodiments, the lift-eyes 500, 505, 510 include operational bores 530, 535, 540, respectively, extending the full width W1, W2, W3 of each lift-eye 500, 505, 510, respectively. In several exemplary embodiments, the operational bores 530, 535, 540 are configured to allow the lift-eyes 500, 505, 510, respectively, to connect to a fabricated structure carrying device. A fabricated structure carrying device may be, for example, a hook or attachment on a crane or other connecting carrying device adapted to lift and/or move the fabricated structure apparatus.

The lift-eyes 500, 505, 510 may be manufactured in a variety of lengths such as L1, L2, L3 and widths W1, W2, W3, respectively. The cheek plates 511*a* and 511*b*, 512*a* and 512*b*, and 513*a* and 513*b* may be manufactured in a variety of widths W4, W5, W6, respectively. In several exemplary embodiments, the variability in dimensions of the lift-eyes 500, 505, 510 and the respective cheek plates 511*a* and 511*b*, 512*a* and 512*b*, and 513*a* and 513*b* allows lift-eye-cheek plate combinations to withstand varying shipping conditions and loads. In one embodiment, the lift-eyes 500, 505, 510 are rated for a specific tonnage of a fabricated structure and equipment to be shipped. In one example, the lift-eye 500 is rated for 25 ton structures, the lift-eye 505 is rated for 17 ton structures, and the lift-eye 510 is rated for 9 ton structures. Other load ratings may be established as desired based on the structure and strength of the lift-eyes. In several exemplary embodiments, the overall width W7, of a lift-eye-cheek plate combination is constant. In several exemplary embodiments, the lift-eyes 500, 505, 510 are interchangeable with each other, with the lift-eye 305, and with other lift-eyes (not shown) despite differences in dimensions and load-withstanding capabilities because of the constant lift-eye-cheek plate combination width W7.

The lift-eyes 500, 505, 510 are disposed in corresponding lift-eye housings such as the lift-eye housing 300 described above with reference to FIGS. 3 and 4. In some aspects, the entire lift-eye housings 300 are exchangeable within the frame 400, and not just the lift-eyes themselves. Accordingly, the lift-eye housings may be made with separate tonnage ratings in the same manner described above.

Figure 6:
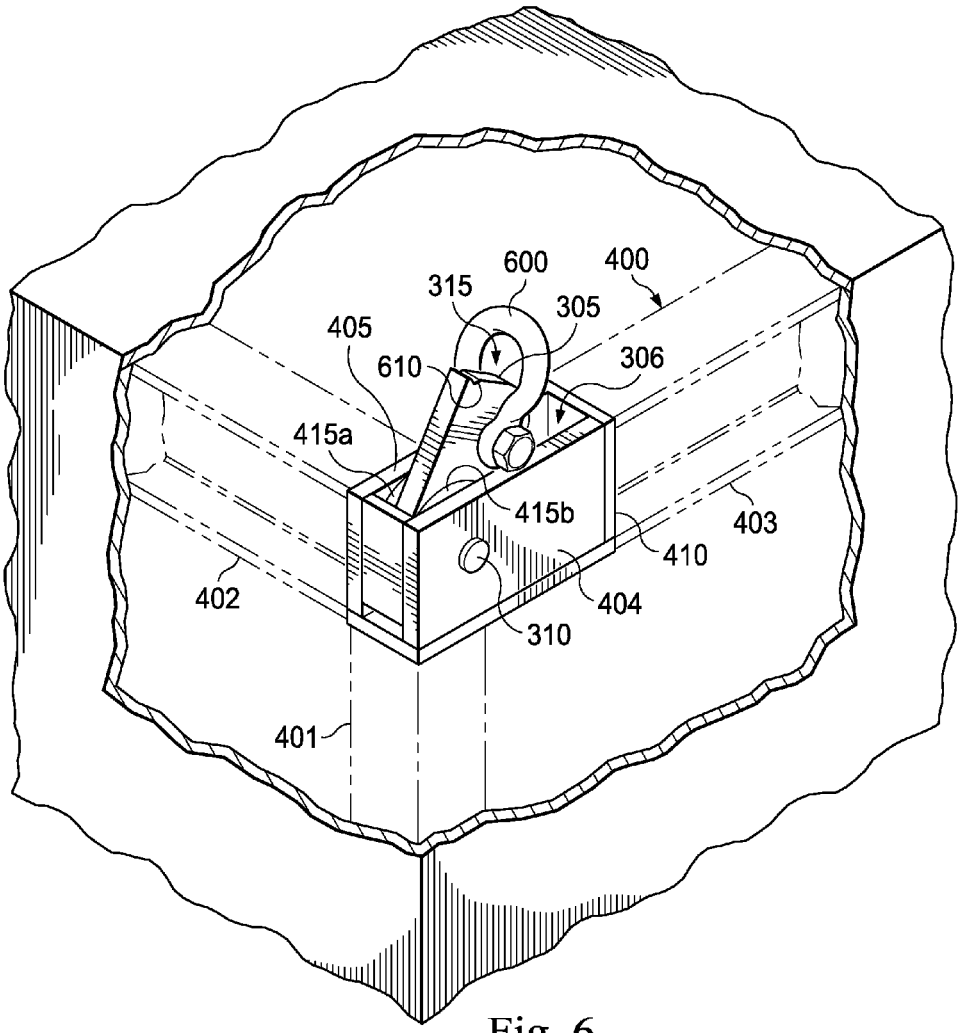
FIG. 6 is a perspective view of an apparatus as a portion of a fabricated structure shown in FIG. 2 in operation according to one or more aspects of the present disclosure.

Referring to FIG. 6, illustrated is a perspective view of the lift-eye 305 in a deployed position during operation with a connecting device 600 attached to the lift-eye 305 via the operation bore (not shown). In one embodiment, the connecting device 600 is a hook. However, the connecting device 600 may be configured as a chain, an attachment on a crane, and/or a variety of connecting devices known in the art. In several exemplary embodiments, the lift-eye 305 is configured to freely pivot about the removable pivot pin 310 such that when rotated less than 90 degrees from the stowed position, the lift-eye 305 is biased by gravity into the stowed position within the lift-eye housing 300. It should also be understood that the lift-eye 305 typically is not adapted to rotate entirely around the pivot pin 310 due to the arrangement of having the lift-eye 305 sized and dimensioned in various embodiments to fit in a recess between the strut and beams of the fabricated structure. Therefore, in one exemplary embodiment, removal of the connecting device 600 would result in the lift-eye 305 returning to the stowed position within the lift-eye housing 300. In another exemplary embodiment, a user may rotate the lift-eye 305 into a neutral condition where it is not biased into the stowed position. This may include rotating the lift-eye 305 about the removable pivot pin 310 a distance greater than 90 degrees from the stowed position such that the lift-eye 305 remains deployed through the opening 306 of the lift-eye housing 300. The lift-eye may then be supported by an edge of the lift-eye housing or other structure. In some embodiments, this may also be achieved with a ratcheting mechanism that requires release for the lift-eye 305 to return to the stowed position, or any number of other suitable structures or techniques for doing so.

In several exemplary embodiments, the lift-eye 305 includes a finger-grip slot 610 disposed in the distal portion 315 of the lift-eye 305. In one embodiment, the finger-grip slot 610 is configured to enable a user to more easily move the lift-eye 305 from the stowed position within the lift-eye housing 300 to the deployed position with a distal portion 315 extending out of the lift-eye housing 300 to enable attachment of a connecting device 600. In one embodiment, the user may apply a human force to the finger-grip slot 610 to manually pivot the lift-eye 305 about the removable pivot pin 310. However, a user may also apply another mechanical force, a magnetic force, and/or a variety of other forces or combination of forces available in the art to pivot the lift-eye 305 about the removable pivot pin 310.

Because of its arraignment, the fabricated structures disclosed herein enable shipment of larger and more extensive goods with decreased costs by maximizing the volume that may be used for the actual structure. For example, when the fabricated structure is a portion of a drilling rig, the space savings found by the pivotable lift-eye may decrease the overall shipping costs by reducing the volume occupied by the portion of the drilling rig. In some aspects, the fabricated structure helps oil and gas companies ship drilling equipment and systems more efficiently with regard to expense and time. In particular, the lift-eye system disclosed herein is disposed within the frame of the fabricated structure such that, when stowed, the lift-eye does not occupy any storage space within the fabricated structure and multiple fabricated structures may be stacked to abut end to end, side-to-side, and over and under each other during transportation, reducing the overall volume occupied by each fabricated structure. Further, the lift-eye disclosed herein is readily exchangeable for lift-eyes capable of withstanding varying loads by means of removing a removable pivot pin. The exchangeable lift-eyes are coupled to cheek plates of varying widths such that the overall lift-eye-cheek plate combination for any lift-eye occupies a constant width within the lift-eye housing. The removable pivot pin is accessible from outside the fabricated structure facilitating a quick replacement of one lift-eye with a more appropriate lift-eye given the shipping needs without any major product or component disassembly. The positioning of the lift-eye system within the fabricated structure and the ease of exchange of individual lift-eyes saves companies time and money when shipping equipment around the globe.

In view of all of the above features, one of ordinary skill in the art will readily recognize that the present disclosure introduces a fabricated apparatus including a strut; a first beam; a second beam; a lift-eye housing interfacing with the strut, the first beam, and the second beam, and having an opening formed therein; and a lift-eye disposed within the lift-eye housing and configured to support the weight of the fabricated apparatus, the lift-eye being reversibly pivotable between a stowed position within the lift-eye housing and a deployed position where a distal portion of the lift-eye projects out of the opening.

According to one aspect, the lift-eye housing is disposed directly along a top portion of the strut. According to another aspect, the lift-eye housing includes an outer wall and an inner wall, the inner wall abutting against and connected to an end portion of the first beam. According to yet another aspect, the lift-eye housing includes an end wall abutting against and connected to an end portion of the second beam. According to still yet another aspect, the apparatus includes a removable pivot pin, wherein the removable pivot pin passes through the lift-eye housing and the lift-eye. According to still yet another aspect, the apparatus comprises an exterior sidewall adjacent the outer wall, wherein the removable pivot pin passes through the outer wall, the inner wall, and the exterior sidewall. According to still yet another aspect, the removable pivot pin is accessible from outside the fabricated apparatus. According to still yet another aspect, the lift-eye includes a finger-grip slot disposed in the distal portion.

The present disclosure also introduces a fabricated apparatus, comprising: a first exterior sidewall, a second exterior sidewall, and an upper wall intersecting at a corner; a lift-eye housing disposed at the corner and having an outer wall, an inner wall, and an opening facing in the direction of the upper wall; a lift-eye disposed within the lift-eye housing and configured to support the weight of the shipping apparatus, the lift-eye being configured to reversibly pivot between a stowed position within the lift-eye housing and a deployed position where a distal portion of the lift-eye projects out of the opening; and a removable pivot pin extending through the lift-eye housing and the lift-eye, the pivot pin being configured to be accessed from outside the fabricated apparatus.

In an aspect, the removable pivot pin passes through the second exterior sidewall of the fabricated apparatus, and through the outer wall and the inner wall of the lift-eye-housing. In an aspect, the apparatus includes a strut disposed between and supporting the first exterior sidewall and the second exterior sidewall, wherein the lift-eye housing is disposed directly along the top of the strut. In an aspect, the apparatus includes a first beam disposed between and connecting the first exterior sidewall and the upper wall, wherein the inner wall of the lift-eye housing abuts against an end of the first beam. In an aspect, the apparatus includes a second beam disposed between and connecting the second exterior sidewall and the upper wall, wherein the outer wall of the lift-eye housing abuts against an end of the second beam. In an aspect, the lift-eye includes a finger-grip slot disposed in the distal portion. In an aspect, the lift-eye is coupled to a set of cheek plates. In an aspect, the lift-eye and cheek plates form a pivot pin hole, wherein the pivot pin hole is configured to encompass and help retain the removable pivot pin. In an aspect, the lift-eye comprises an operation hole, wherein the operation hole is configured to enable connection between the lift-eye and a connecting device. In an aspect, the lift-eye is removable from the lift-eye housing by removing the removable pivot pin from the lift-eye housing and the lift-eye.

The present disclosure also introduces a method, comprising: removing a lift-eye device from a frame of a fabricated structure; selecting a replacement lift-eye device depending on an expected load from a plurality of lift-eye devices having different load ratings; inserting the replacement lift-eye device into the frame of the fabricated structure; and securing the lift-eye device into the frame of the fabricated structure.

In an aspect, the lift eye device is a lift-eye. In an aspect, the lift eye device is a lift-eye housing. In an aspect, removing the lift-eye device comprises removing a pivot pin of the lift-eye device from a pivot pin hole of a lift-eye and removing the lift eye, the method further comprising: inserting the pivot pin into a pivot pin hole of a replacement lift-eye so that the replacement lift eye is configured to reversibly pivot between a stowed position and a deployed position. In an aspect, the method includes accessing the pivot pin from a location outside the fabricated structure.

According to still yet another aspect, the apparatus includes a set of cheek plates coupled to the lift-eye. According to still yet another aspect, the lift-eye and cheek plates form a pivot pin hole that is configured to encompass the removable pivot pin. According to still yet another aspect, the lift-eye includes an operation hole, wherein the operation hole is configured to enable the lift-eye to connect to a connecting device.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A fabricated apparatus having an interior space, comprising:

a strut;

a first beam;

a second beam;

a lift-eye housing interfacing with the strut and the first beam and the second beam, the lift-eye housing having an opening formed therein, wherein the lift-eye housing is contained entirely within a framework of the strut and the first beam and the second beam so as not to encroach into the interior space of the fabricated apparatus; and a lift-eye, coupled between a set of cheek plates, disposed within the lift-eye housing and configured to support the weight of the fabricated apparatus, the lift-eye being reversibly pivotable between a stowed position within the lift-eye housing and a deployed position where a distal portion of the lift-eye projects out of the opening.

2. The apparatus of claim 1, wherein the lift-eye housing is disposed directly along a top portion of the strut.

3. The apparatus of claim 2, wherein the lift-eye housing comprises an outer wall and an inner wall, the inner wall of the lift-eye housing abutting against and connected to an end portion of the first beam.

4. The apparatus of claim 3, wherein the lift-eye housing comprises an end wall that abuts against and is connected to an end portion of the second beam.

5. The apparatus of claim 3, further comprising a removable pivot pin passing through the lift-eye housing, the lift-eye, and the set of cheek plates.

6. The apparatus of claim 5, further comprising an exterior sidewall adjacent the outer wall, wherein the removable pivot pin passes through the exterior sidewall.

7. The apparatus of claim 5, wherein the removable pivot pin is accessible from outside the fabricated apparatus.

8. The apparatus of claim 1, wherein the lift-eye includes a finger-grip slot disposed in the distal portion.

9. A fabricated apparatus, comprising:

a first exterior sidewall, a second exterior sidewall, and an upper wall intersecting at a corner;

a lift-eye housing disposed at the corner and having an outer wall, an inner wall, and an opening facing in the direction of the upper wall;

a lift-eye, coupled to a set of cheek plates, disposed within the lift-eye housing, and configured to support the weight of the apparatus, the lift-eye being configured to reversibly pivot between a stowed position within the lift-eye housing and a deployed position where a distal portion of the lift-eye projects out of the opening; and a removable pivot pin extending through the lift-eye housing and the lift-eye, the pivot pin being configured to be accessed from outside the fabricated apparatus.

10. The apparatus of claim 9, wherein the removable pivot pin passes through the second exterior sidewall of the fabricated apparatus, and through the outer wall and the inner wall of the lift-eye housing.

11. The apparatus of claim 9, comprising a strut disposed between and supporting the first exterior sidewall and the second exterior sidewall, wherein the lift-eye housing is disposed directly along the top of the strut.

12. The apparatus of claim 9, comprising a first beam disposed between and connecting the first exterior sidewall and the upper wall, wherein the inner wall of the lift-eye housing abuts against an end of the first beam.

13. The apparatus of claim 9, comprising a second beam disposed between and connecting the second exterior sidewall and the upper wall, wherein the outer wall of the lift-eye housing abuts against an end of the second beam.

14. The apparatus of claim 9, wherein the lift-eye includes a finger-grip slot disposed in the distal portion.

15. The apparatus of claim 9, wherein the lift-eye and set of cheek plates include a pivot pin hole, wherein the pivot pin hole is configured to encompass and help retain the removable pivot pin.

16. The apparatus of claim 9, wherein the lift-eye comprises an operation hole, wherein the operation hole is configured to enable connection between the lift-eye and a connecting device.

17. The apparatus of claim 9, wherein the lift-eye is removable from the lift-eye housing by removing the removable pivot pin from the lift-eye housing and the lift-eye.

18. A fabricated apparatus having an interior space, comprising:

a strut;

a first beam;

a second beam;

a lift-eye housing interfacing with the strut and the first beam and the second beam, the lift-eye housing having an opening formed therein; and a lift-eye, coupled to a set of cheek plates, disposed within the lift-eye housing, and configured to support the weight of the fabricated apparatus, the lift-eye being reversibly pivotable between a stowed position within the lift-eye housing and a deployed position where a distal portion of the lift-eye projects out of the opening.

19. The apparatus of claim 18, wherein the lift-eye housing is disposed directly along a top portion of the strut.

20. The apparatus of claim 19, wherein the lift-eye housing comprises an outer wall and an inner wall, the inner wall of the lift-eye housing abutting against and connected to an end portion of the first beam.

21. The apparatus of claim 20, further comprising a removable pivot pin passing through the lift-eye housing, the lift-eye, and the set of cheek plates.

22. The apparatus of claim 21, wherein the removable pivot pin is accessible from outside the fabricated apparatus.

* * * * *